US011067938B2

(12) United States Patent
Ogino et al.

(10) Patent No.: US 11,067,938 B2
(45) Date of Patent: Jul. 20, 2021

(54) CLEANING UNIT, CARTRIDGE, IMAGE FORMING APPARATUS

(71) Applicant: CANON KABUSHIKI KAISHA, Tokyo (JP)

(72) Inventors: Hiroki Ogino, Mishima (JP); Kohei Matsuda, Fujisawa (JP); Hiraku Sasaki, Susono (JP); Kentaro Kawata, Suntou-gun (JP); Yasushi Katsuta, Tokyo (JP); Shun Sato, Minamiashigara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/826,474

(22) Filed: Mar. 23, 2020

(65) Prior Publication Data

US 2020/0310332 A1 Oct. 1, 2020

(30) Foreign Application Priority Data

Mar. 29, 2019 (JP) ..... JP2019-067481

(51) Int. Cl.
*G03G 21/00* (2006.01)

(52) U.S. Cl.
CPC ..... *G03G 21/0011* (2013.01)

(58) Field of Classification Search
CPC ..... G03G 21/0011
See application file for complete search history.

(56) References Cited

U.S. PATENT DOCUMENTS 6,622,001 B2 9/2003 Arimitsu et al.
7,245,867 B2 * 7/2007 Baek ..... G03G 21/12 399/358
2004/0258441 A1 * 12/2004 Park ..... G03G 21/105 399/350

FOREIGN PATENT DOCUMENTS

JP 2002-123143 A 4/2002
JP 2006-267930 A 10/2006
JP 2016-184142 A 10/2016

OTHER PUBLICATIONS

U.S. Appl. No. 16/826,408, filed Mar. 23, 2020 (First Named Inventor: Kohei Matsuda).
U.S. Appl. No. 16/820,758, filed Mar. 17, 2020 (First Named Inventor: Shun Sato).

* cited by examiner

*Primary Examiner* — Victor Verbitsky
(74) *Attorney, Agent, or Firm* — Venable LLP

(57) ABSTRACT

Provided are a cleaning member that removes a developer from the surface of an image bearing member that is attached to an opening of a frame; a transport member that transports developer removed from the surface of the photosensitive member drum by the cleaning member, from an opening side of the frame towards an opposing deep side; and a driving unit for driving the transport member such that the transport member moves relatively to the cleaning member. The transport member is driven by the driving unit such that an absolute value of maximum acceleration at the time of movement of the transport member in a direction from the opening side of the frame towards the deep side is smaller than an absolute value of maximum acceleration at the time of movement in a direction from the deep side towards the opening side.

11 Claims, 15 Drawing Sheets

CLEANING UNIT, CARTRIDGE, IMAGE FORMING APPARATUS

BACKGROUND OF THE INVENTION

Field of the Invention

The present invention relates to a cleaning unit and a cartridge used in an image forming apparatus.

The term image forming apparatus denotes for instance an electrophotographic copier, an electrophotographic printer (for instance a laser beam printer or an LED printer), a facsimile machine or the like, in which an image is formed on a recording medium (recording material) by relying on an electrophotographic image formation scheme.

Description of the Related Art

As a unit for transporting waste toner accommodated in a cleaning container of a cartridge configured to be attachable to and detachable from the apparatus body of an image forming apparatus, Japanese Patent Application Publication No. 2002-123143 discloses providing a transport member that moves, in the interior of the cleaning container, in conjunction with the rotation of a crankshaft. The term waste toner denotes toner (developer) that remains on the surface of a photosensitive member drum, as an image bearing member, without being transferred to a recording material or the like, at the time of transfer of a toner image (developer image) supported on the photosensitive member drum, to the recording material or the like.

SUMMARY OF THE INVENTION

In the configuration disclosed in Japanese Patent Application Publication No. 2002-123143, waste toner is transported by a transport member in conjunction with the rotation of a crankshaft, and accordingly part of the waste toner is transported towards a cleaning member when the transport member moves so as to approach to the cleaning member. In such a configuration, however, the waste toner scraping performance of the cleaning member deteriorates, and faulty cleaning may occur, when waste toner and paper powder become compacted in the vicinity of the cleaning member. As a result, it is then necessary for instance to widen the space in the vicinity of the cleaning member, to thereby suppress faulty cleaning.

It is an object of the present invention to provide a scheme that allows transporting a developer, removed from the surface of an image bearing member, towards a developer accommodating part, with greater space savings and more efficiently.

With a view to attaining the above goal, a cleaning unit of the present invention has:

a frame which is provided with an opening for attaching an image bearing member;

a cleaning member which is provide on the frame and which removes a developer from the surface of the image bearing member;

a transport member which is provided inside the frame and transports the developer removed by the cleaning member from an opening side of the frame to a deep side of the frame, the deep side being opposite to the opening side; and a driving unit which drives the transport member such that, the transport member moves relatively to the cleaning member, and an absolute value of maximum acceleration at the time of movement of the transport member in a direction from the opening side towards the deep side is smaller than an absolute value of maximum acceleration at the time of movement in a direction from the deep side towards the opening side.

With a view to attaining the above goal, a cartridge of the present invention, attachable to and detachable from a main body of an image forming apparatus, has:

an image bearing member; and a cleaning unit, wherein the cleaning unit comprises:

a frame which is provided with an opening for attaching the image bearing member;

a cleaning member which is provided on the frame and which removes a developer from the surface of the image bearing member;

a transport member which is provided inside the frame and transports the developer removed by the cleaning member, from an opening side of the frame to a deep side of the frame, the deep side being opposite to the opening side; and a driving unit for driving the transport member such that the transport member moves relatively to the cleaning member, and an absolute value of maximum acceleration at the time of movement of the transport member in a direction from the opening side towards the deep side is smaller than an absolute value of maximum acceleration at the time of movement in a direction from the deep side towards the opening side.

With a view to attaining the above goal, an image forming apparatus of the present invention has:

a main body; and the cartridge of the present invention, attachable to and detachable from the main body the cartridge comprises:

an image bearing member; and a cleaning unit, wherein the cleaning unit comprises:

a frame which is provided with an opening for attaching the image bearing member;

a cleaning member which is provided on the frame and which removes a developer from the surface of the image bearing member;

a transport member which is provided inside the frame and transports the developer removed by the cleaning member, from an opening side of the frame to a deep side of the frame, the deep side being opposite to the opening side; and a driving unit for driving the transport member such that the transport member moves relatively to the cleaning member, and an absolute value of maximum acceleration at the time of movement of the transport member in a direction from the opening side towards the deep side is smaller than an absolute value of maximum acceleration at the time of movement in a direction from the deep side towards the opening side.

The present invention allows transporting a developer, removed from the surface of an image bearing member, towards a developer accommodating part, with greater space savings and more efficiently.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

In the explanation below, the longitudinal direction of a cartridge is the axial direction of an image bearing member. Left and right denote herein left and right with a recording material viewed from above, along the transport direction of the recording material. The top face of the cartridge is the surface positioned at the top, and the lower face is the surface positioned at the bottom, in a state where the cartridge is fitted to an apparatus body.

Embodiment 1

Overall Description of an Image Forming Apparatus

Figure 1:
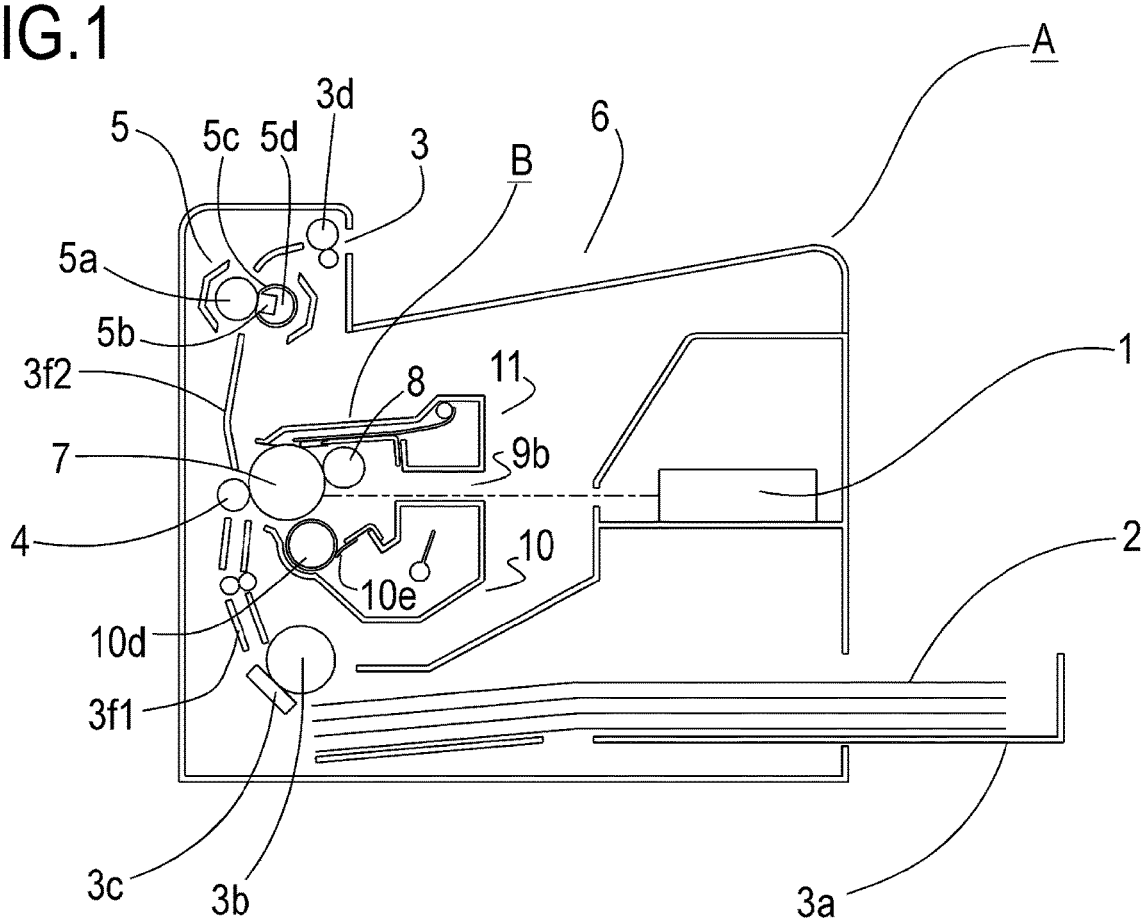
FIG. 1 is a schematic cross-sectional diagram of an image forming apparatus according to Embodiment 1.

The overall structure of an electrophotographic image forming apparatus (hereafter "image forming apparatus") will be explained next with reference to FIG. 1. FIG. 1 is a schematic cross-sectional diagram of an image forming apparatus fitted with a cartridge B according to Embodiment 1 of the present invention. More specifically, FIG. 1 is a schematic cross-sectional diagram of a laser beam printer which is one embodiment of an image forming apparatus.

The attitudes of the image forming apparatus, process cartridge and cleaning unit 11 illustrated in FIGS. 1 to 3B are attitudes at the time of use of the image forming apparatus. The positional relationships, directions and so forth of the various members in the present specification denote positional relationships, directions and so forth in these attitudes. Specifically, the top-bottom direction on the paper in FIGS. 1 to 3B corresponds to a vertical direction (gravity direction), and the left-right direction on the paper corresponds to the horizontal direction. The setting of the arrangement configuration is a setting premised on the image forming apparatus being installed on a horizontal plane, as an ordinary installation state.

As illustrated in FIG. 1, an image forming apparatus (laser beam printer) is provided with an image forming apparatus body (hereafter main body) A, and a cartridge B attachable to and detachable from the main body A. A photosensitive member drum 7 as an image bearing member is disposed in the interior of the main body A.

The image forming apparatus according to the present example irradiates information light (laser light) based on image information, from an optical system 1 as an optical unit (optical device), onto a drum-shaped photosensitive member drum 7, to form an electrostatic latent image on the peripheral surface of the photosensitive member drum 7. The electrostatic latent image is developed into a toner image (developer image) by a developer (hereafter referred to as "toner") on the peripheral surface of the photosensitive member drum 7. In synchrony with formation of the toner image, a recording material (for instance recording paper, an OHP sheet, cloth or the like) 2 is separated and fed from a cassette 3*a*, sheet by sheet, by a pick up roller 3*b* and a pressing member 3*c* that is pressed against the pick up roller 3*b*.

The recording material 2 thus fed is transported, along a transport guide 3*f*1, up to a transfer section T in which the photosensitive member drum 7 of the cartridge B and a transfer roller 4 as a transfer member oppose each other. A toner image formed on the photosensitive member drum 7 by the transfer roller 4 having voltage applied thereto is transferred to the recording material 2 having been transported to the transfer section T, and the recording material 2 is transported to a fixing apparatus 5 along a transport guide 3*f*2.

The fixing apparatus 5 is made up of a driver roller 5*a*, and a fixing rotating member 5*c* having a heater 5*b* built therein and made up of a tubular sheet that is rotatably supported by a support 5*d*, such that the fixing rotating member 5*c* fixes the transferred toner image through application of heat and pressure to passing recording material 2.

The discharge rollers 3*d* are configured to transport the recording material 2 having the toner image fixed thereto, and discharge the recording material 2 to a discharge section 6, via a reverse transport path. In the present example the transport device 3 is for instance made up of the pick up roller 3*b*, the pressing member 3*c* and the discharge rollers 3*d*.

Cartridge

Figure 2:
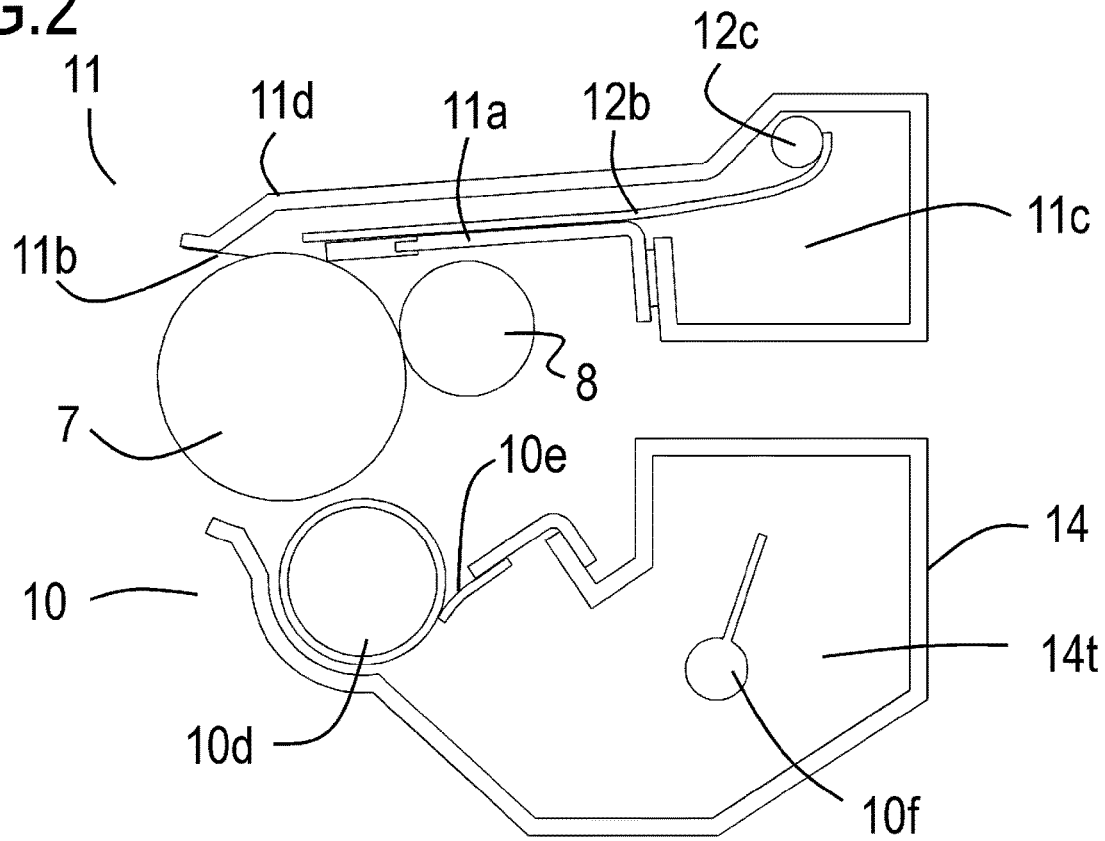
FIG. 2 is a schematic cross-sectional diagram of a cartridge according to Embodiment 1.

The overall structure of the cartridge B (process cartridge) will be explained next schematically with reference to FIG. 2. FIG. 2 is a schematic cross-sectional diagram of the cartridge B. As illustrated in FIG. 2, the cartridge B is provided with a photosensitive member drum 7 and at least one process unit. Examples of process unit include for instance a charging member for charging the photosensitive member drum 7, a developing unit for developing the electrostatic latent image formed on the photosensitive member drum 7, and a cleaning unit for cleaning toner remaining on the photosensitive member drum 7.

The cartridge B has the below-described cleaning unit 11 and a developing unit 10.

Schematically, the cleaning unit 11 is made up of the photosensitive member drum 7, a charging roller 8 and a cleaning frame 11*d*. The cleaning frame 11*d* is provided with a cleaning blade 11*a*, a scooping sheet 11*b*, a waste toner accommodating portion 11*c*, a waste toner transport member 12*b* and a transport shaft 12*c*. Although described in further detail below, toner having been removed from the surface of the photosensitive member drum 7 by the cleaning blade 11*a* as a cleaning member is transported towards the deep side of the waste toner accommodating portion 11*c* as a developer accommodating part, by the waste toner transport member 12*b* as a developer transport member. The waste toner transport member 12*b* moves relatively to the cleaning blade 11*a* as a result of rotation (swinging) of the transport shaft 12*c*, as a rotating shaft, which rotates upon reception of a driving force from a driving source such as a motor, not shown. The relative movement of the waste toner transport member 12*b* is herein a reciprocating movement between the surface side of the photosensitive member drum 7 and the deep side of the waste toner accommodating portion 11*c*.

The developing unit 10 is made up of the developing roller 10*d*, a developing blade 10*e*, and an accommodating container 14 having a stirring member 10*f* built therein. Toner is held in a toner accommodating section 14*t* in the interior of the accommodating container 14.

Figure 3A:
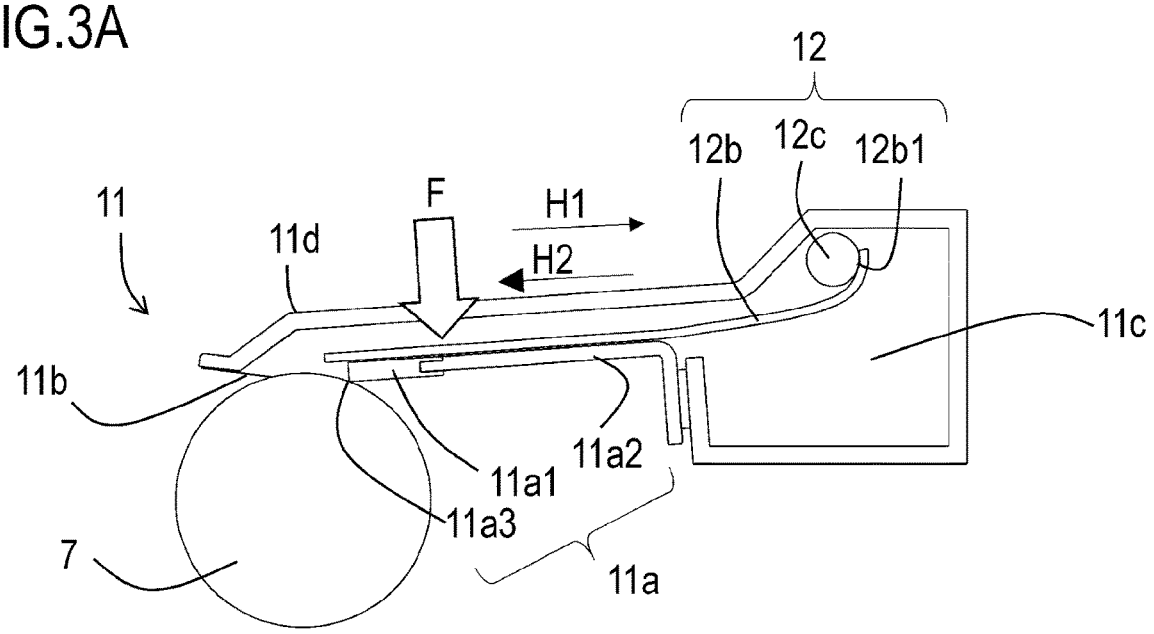
FIGS. 3A and 3B are a set of schematic cross-sectional diagrams of a cleaning unit according to Embodiment 1.
Figure 3B:
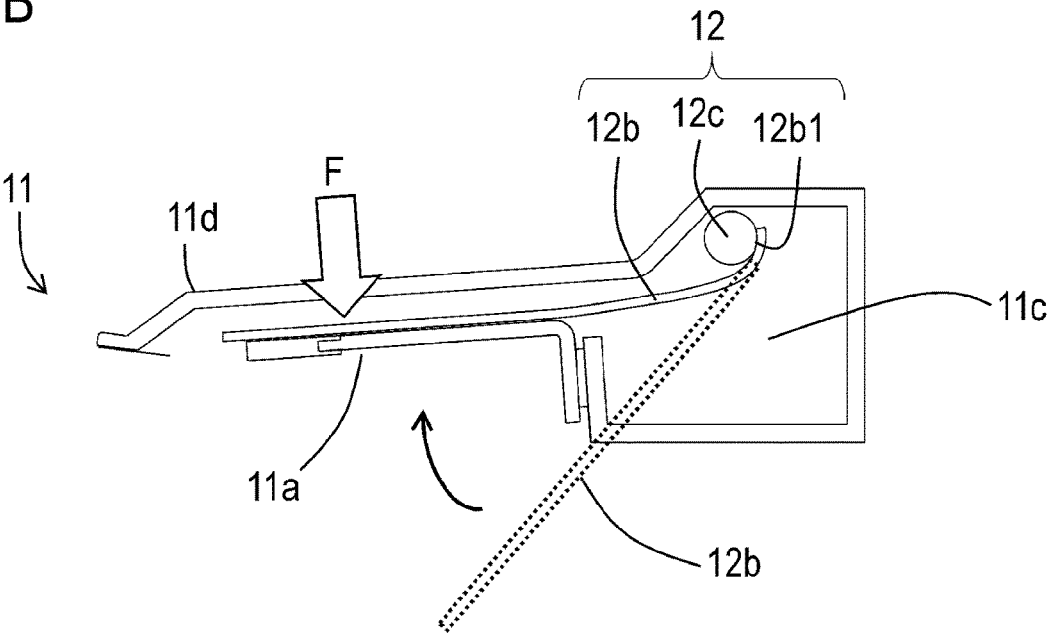

The direction in which the waste toner transport member 12*b* transports the waste toner, in the above configuration, is a movement direction H1 as a developer transport direction (see FIG. 3A) from a cleaning portion 11*a*3 of the cleaning blade 11*a* towards the waste toner accommodating portion 11*c* (i.e. a direction from the opening side of the cleaning frame 11*d* towards the deep side on the opposite side of the opening). FIG. 3A illustrates also a movement direction H2 as an opposite direction (reverse direction) of the developer transport direction.

The image formation process in the cartridge B will be explained with reference to FIGS. 1 and 2.

Firstly, the photosensitive member drum 7 having a photosensitive layer is caused to rotate, and the surface of the photosensitive member drum 7 is charged uniformly through application of voltage to the charging roller 8 which is a charging member. The charged photosensitive member drum 7 is exposed with information light (light image) based on image information from the optical system 1, via an exposure opening 9*b*. An electrostatic latent image (electrostatic image) becomes formed on the surface of the photosensitive member drum 7, and the electrostatic latent image is developed by the developing unit 10. The developing unit 10 is also referred to as a developing apparatus.

The developing unit 10 rotatably supports the developing roller 10*d* as a developer carrier that carries developer. A toner layer imparted with triboelectric charge by the developing blade 10*e* becomes formed, accompanying this rotation, on the surface of the developing roller 10*d*. This toner is caused to migrate (developing unit) to the photosensitive member drum 7 in accordance with the electrostatic latent image, to thereby form a toner image that constitutes a visible image.

Voltage of reverse polarity to that of the toner image is then applied to the transfer roller 4, to transfer the toner image from the photosensitive member drum 7 to the recording material 2; thereafter, for instance untransferred toner remaining on the photosensitive member drum 7 is scraped off by the cleaning blade 11*a* that is fixed to the cleaning frame 11*d* illustrated in FIG. 2. Concurrently, the untransferred toner is scooped by the scooping sheet 11*b* and gathered in the waste toner accommodating portion 11*c* by the waste toner transport member 12*b*. Residual toner on the photosensitive member drum 7 is thus removed by these cleaning unit.

The image formation process of the cartridge B is thus configured in the above manner.

Configuration of the Cleaning Unit and the Waste Toner Transport Mechanism

The configuration of the cleaning unit and of the waste toner transport mechanism will be explained next with reference to FIGS. 3A to 9.

As illustrated in FIG. 3A, the cleaning unit 11 is provided with the photosensitive member drum 7, the cleaning blade 11*a*, the charging roller 8, the waste toner transport mechanism 12, the cleaning frame 11*d*, the waste toner accommodating portion 11*c* and the scooping sheet 11*b*. The waste toner transport mechanism 12 is made up of the waste toner transport member 12*b*, the transport shaft 12*c*, a swinging rotating member 12*a* as an actuated member, a rotating member 15 as an actuating member, and a spring member 16.

The cleaning blade 11*a* is made up of a rubber part 11*a*1 and a sheet metal part 11*a*2, attached to the cleaning frame 11*d*. The abutting portion between the rubber part 11*a*1 of the cleaning blade 11*a* and the photosensitive member drum 7 is referred to as cleaning portion 11*a*3. The cleaning blade 11*a* is disposed so as to extend from one end thereof fixed to the cleaning frame 11*d* towards the other end that abuts on the surface of the photosensitive member drum 7, in a direction opposite to the rotation direction of the photosensitive member drum 7 at the region at which the other end of the cleaning blade 11*a* abuts on the surface of the photosensitive member drum 7.

The cleaning frame 11*d* has an opening for attaching the photosensitive member drum 7, the opening being plugged by the photosensitive member drum 7 attached to the cleaning frame 11*d*, the cleaning blade 11*a* and the scooping sheet 11*b*.

The waste toner transport member 12*b* is a sheet-shaped elastic member (elastically deformable flexible sheet-shaped member) for transporting waste toner. The waste toner transport member 12*b* is made up of a sheet member having a thickness of 0.1 mm, and is fixed to the transport shaft 12*c*, which is connected to the below-described swinging rotating member 12*a*, at a fixing portion 12*b*1 which is one end of the sheet member.

The waste toner transport member 12*b* is configured to pass between the cleaning blade 11*a* and the cleaning frame 11*d* in a state where the lower face of the waste toner transport member 12*b* is urged, by an urging force F, against the top face of the rubber part 11*a*1 of the cleaning blade 11*a*. By assembling the waste toner transport member 12*b* in a state of being deflected between the transport shaft 12*c* and the cleaning blade 11*a*, in the present example an urging structure (urging member for urging the flexible sheet-shaped member towards the cleaning member) is brought about in which the urging force F is generated relying on an elastic restoring force of the waste toner transport member 12*b*. Specifically, the attitude of the waste toner transport member 12*b* in a natural state of not abutting for instance on the cleaning blade 11*a*, is herein a state such as that denoted by the dashed line in FIG. 3B. Through assembly of the waste toner transport member 12*b* in a state of being deflected by the cleaning blade 11*a*, with a starting point at the fixing portion 12b1 at one end side which is a fixed end of the waste toner transport member 12b, a state is brought about in which the lower face (bottom face in the gravity direction) of the waste toner transport member 12b on the side of the other end, i.e. a free, end is urged against the top face of the rubber part 11a1 of the cleaning blade 11a.

Figure 6:
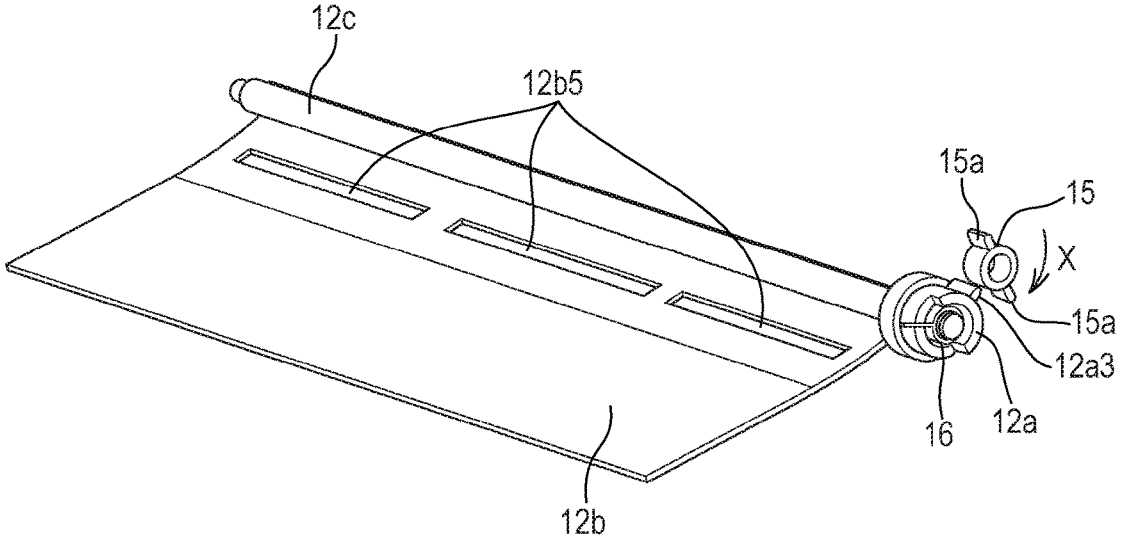
FIG. 6 is an explanatory diagram of the waste toner transport mechanism according to Embodiment 1.

As illustrated in FIG. 6, multiple communicating holes 12b5 are provided in the waste toner transport member 12b, in the vicinity of the transport shaft 12c, at intervals in a direction along the transport shaft 12c of the waste toner transport member 12b.

In the present example the material used in the waste toner transport member 12b is polyethylene terephthalate (PET), but the material is not limited thereto.

The driving structure (driving unit) of the waste toner transport member will be explained next with reference to FIGS. 4A to 9.

Figure 8A:
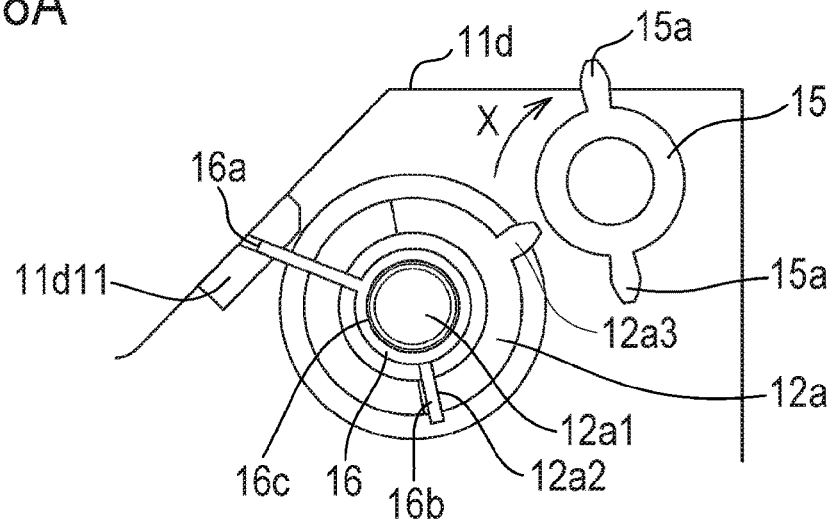
FIGS. 8A to 8C are a set of explanatory diagrams of the waste toner transport mechanism according to Embodiment 1.
Figure 8B:
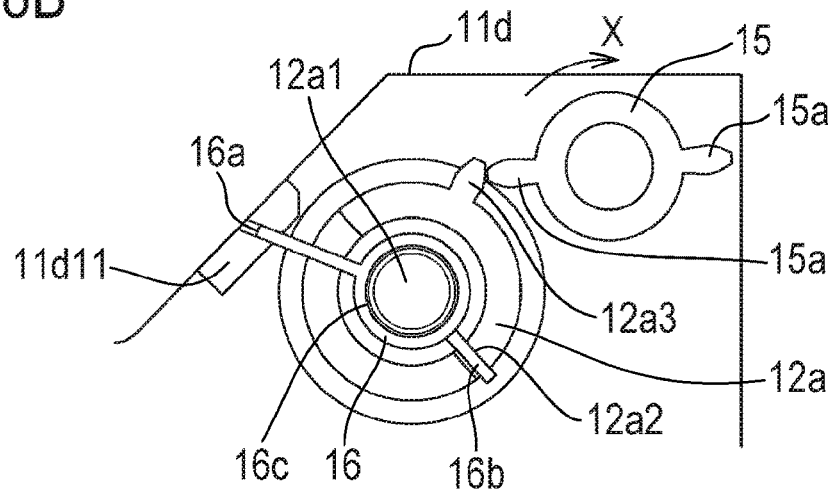
Figure 8C:
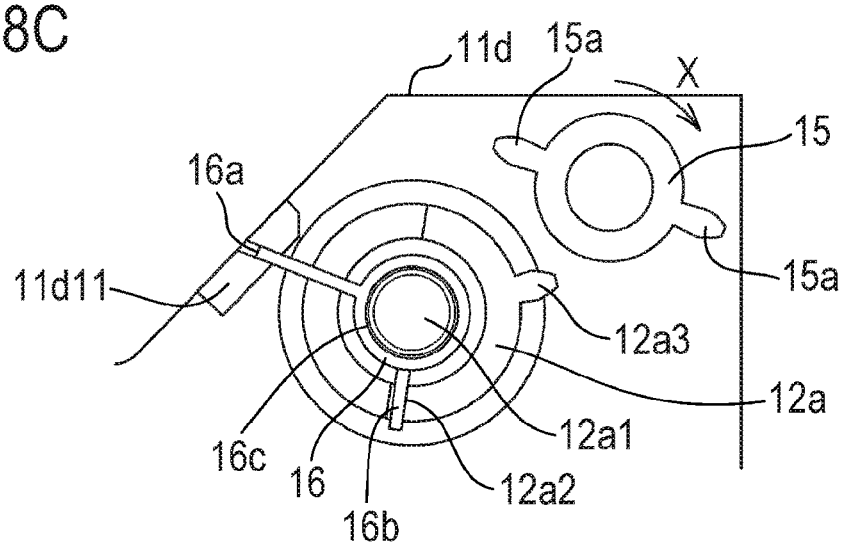
Figure 9:
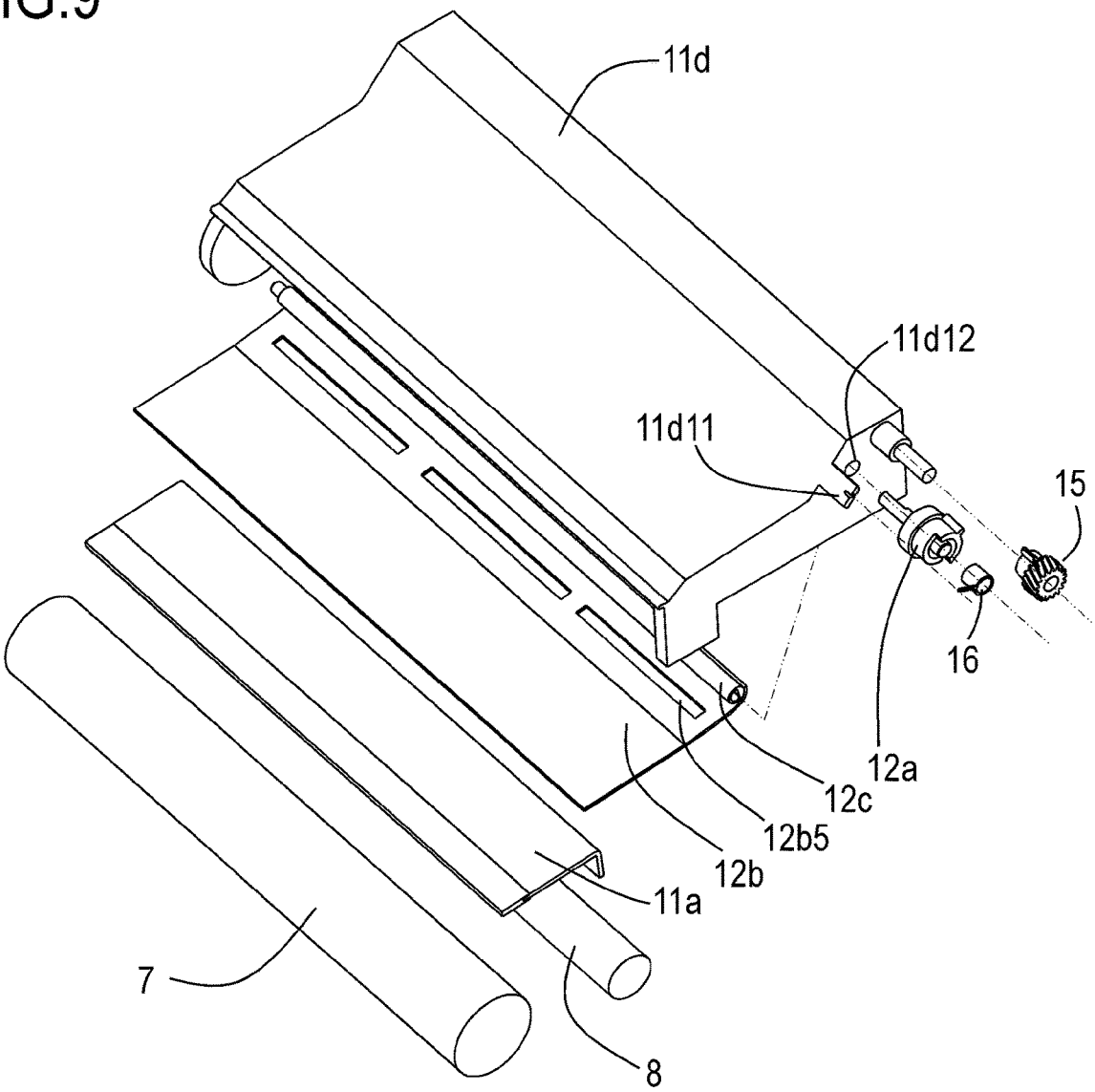
FIG. 9 is an exploded perspective-view diagram of the cleaning unit according to Embodiment 1.

As illustrated in FIG. 9, the transport shaft 12c having the waste toner transport member 12b fixed thereto is disposed within the cleaning frame 11d. A support portion of the rotating member 15 and the swinging rotating member 12a, and a communication hole 11d12 which is a hole for engagement of the transport shaft 12c and the swinging rotating member 12a, are provided in an outer wall of the cleaning frame 11d. Also, a fixing portion 11d11 for fixing a fixed arm 16a of the spring member 16 that is attached to the swinging rotating member 12a is provided on the outer wall of the cleaning frame 11d As illustrated in FIGS. 8A to 8C, the spring member 16 is configured out of a torsion coil spring, and the fixed arm 16a and two arm portions of a movable arm 16b are provided at an end of a cylindrical portion 16c.

The fixed arm 16a is fixed to the fixing portion 11d11 provided on the outer wall of the cleaning frame 11d, the cylindrical portion 16c is supported by the support portion 12a1 provided on the swinging rotating member 12a, and the movable arm 16b is engaged with the engagement portion 12a2.

An actuated portion 12a3 that abuts on the actuating portion 15a of the rotating member 15 described below is provided in the swinging rotating member 12a.

The swinging rotating member 12a is rotatably supported on the outer wall of the cleaning frame 11d, and is configured so that part of the swinging rotating member is engaged with the transport shaft 12c that is provided within the waste toner accommodating portion 11c, through the communication hole 11d12 provided in the outer wall.

As a result of this configuration, the direction in which the urging force of the spring member 16 is generated is set to be substantially the rotation direction of the swinging rotating member 12a and the transport shaft 12c.

Figure 4A:
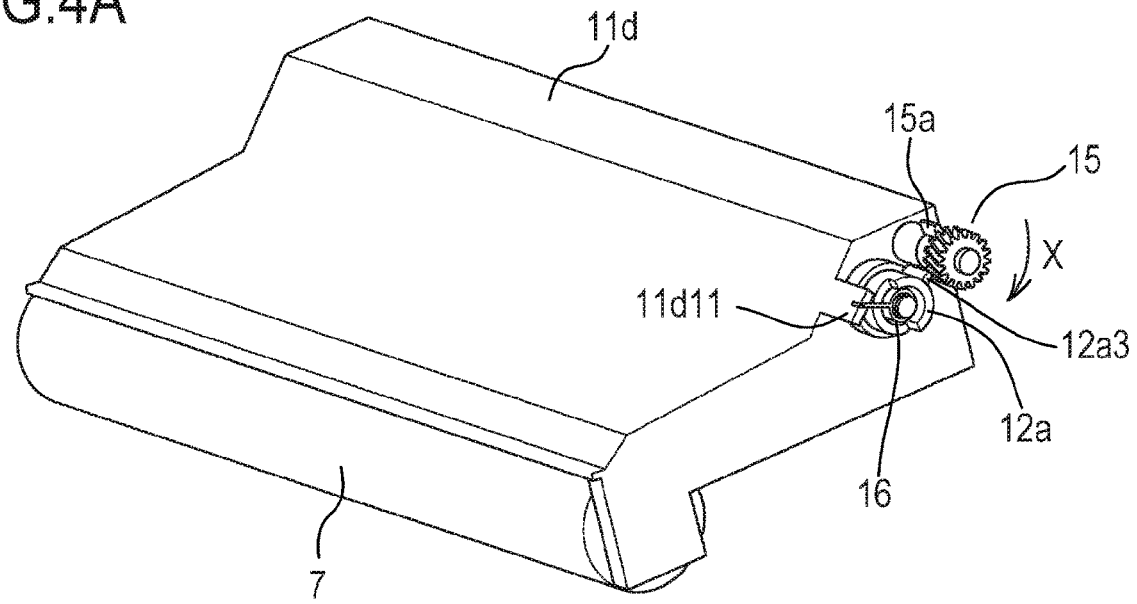
FIGS. 4A and 4B are a set of explanatory diagrams of a waste toner transport mechanism according to Embodiment 1.
Figure 4B:
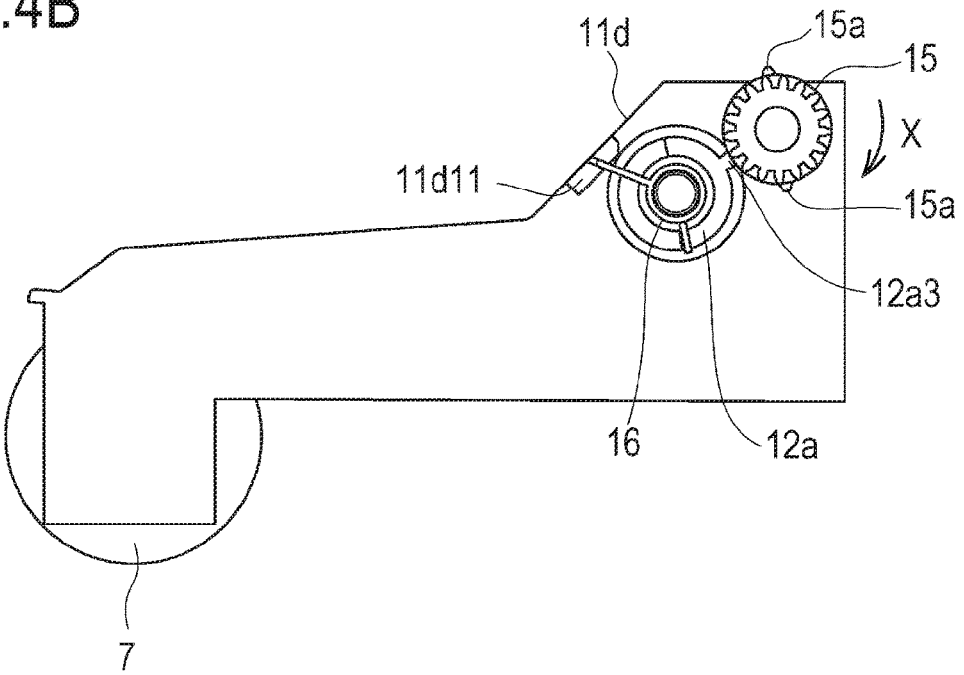
Figure 5A:
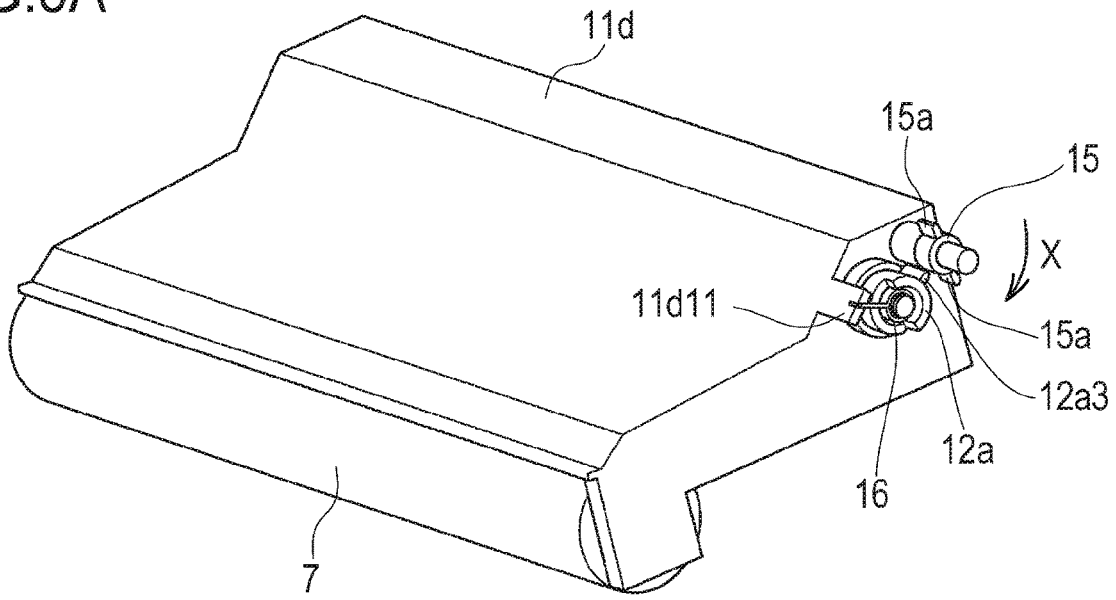
FIGS. 5A and 5B are a set of explanatory diagrams of the waste toner transport mechanism according to Embodiment 1.

The position determined by the angle based on the movable arm 16b and the fixed arm 16a when no load acts on the spring member 16 is set to a neutral position of the swinging rotating member 12a (i.e. a first position at which the urging force exerted by the spring member 16 on the swinging rotating member 12a in the rotation direction is zero), The configuration of the rotating member 15 will be explained next with reference to FIGS. 4A to 5B. FIGS. 4A and 5A are perspective-view diagrams of a waste toner transport mechanism, and FIGS. 4B and 5B are side-view diagrams of a waste toner transport mechanism.

As illustrated in FIGS. 4A to 5B, the rotating member 15 is made up of a step gear having a two-tooth missing gear as an actuating portion 15a, and a helical gear that receives a continuously rotating driving force from a driving force transmission gear (not shown) provided in the main body A.

Figure 5B:
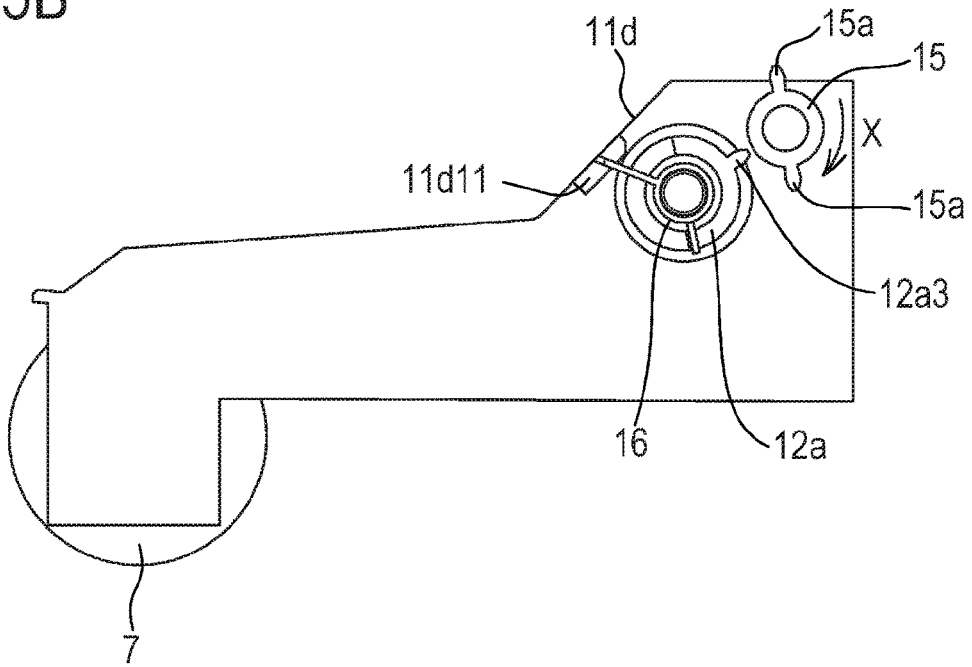

The rotating member 15 is illustrated in FIGS. 5A and 5B with the helical gear omitted in the depiction. On the rotating member 15, the two-tooth missing gear is formed as the actuating portion 15a that acts on the actuated portion 12a3 provided in the swinging rotating member 12a, as illustrated in FIGS. 5A and 5B. The two-tooth missing gear has a shape such that, as a result of rotation of the rotating member 15, the gear actuates and releases repeatedly the actuated portion 12a3 of the swinging rotating member 12a, in the circumferential direction.

The operation during driving input will be explained next with reference to FIGS. 3A to 3B, FIG. 6 and FIGS. 8A to 8C.

Through rotation of the rotating member 15, the state in FIG. 8A switches over to the state illustrated in FIG. 8B, and the two-tooth missing gear as the protruding actuating portion 15a of the rotating member 15 comes in contact with the actuated portion 12a3 of the swinging rotating member 12a. Accompanying the rotation of the swinging rotating member 12a, the waste toner transport member 12b having the fixing portion 12b1 fixed to the transport shaft 12c illustrated in FIGS. 3A and 6 is caused to rotate and move in the transport direction H1. Through rotation of the rotating member 15, moreover, the state of FIG. 8B switches over to the state illustrated in FIG. 8C, and the actuating portion 15a releases the actuated portion 12a3.

As a result of this release operation, the waste toner transport member 12b moves reciprocally accompanying a damping movement of the spring member 16, and such that the rotating member 15 and the actuated portion 12a3 of the swinging rotating member 12a are not in contact with each other, as the reciprocating motion dies down until ceasing.

The above configuration allows the waste toner transport member 12b to move reciprocally accompanying rotation of the rotating member 15, and allows the reciprocating motion to die down and cease accompanying the damping movement.

Waste Toner Transport Action of the Waste Toner Transport Mechanism

The waste toner transport action of the waste toner transport mechanism will be explained next with reference to FIGS. 3A and 3B, FIGS. 7A to 7C and FIGS. 8A to 8C.

Through the action of the rotating member 15 and the spring member 16 on the actuated portion 12a3 and the engagement portion 12a2 of the swinging rotating member 12a, acceleration is imparted to the reciprocation of the waste toner transport member 12b, via the transport shaft 12c, in the movement directions H1 and H2, and the waste toner transport member 12b is caused to oscillate.

Herein FIGS. 7A and 8A, FIGS. 7B and 8B, and FIGS. 7C and 8C, illustrate states in which the phase of the swinging rotating member 12a and the position of the waste toner transport member 12b are in an identical state.

The urging force F that the cleaning blade 11a receives from the waste toner transport member 12b is set to take on a larger value than the weight of waste toner that can be loaded between the waste toner transport member 12b and the cleaning blade 11a.

Figure 7A:
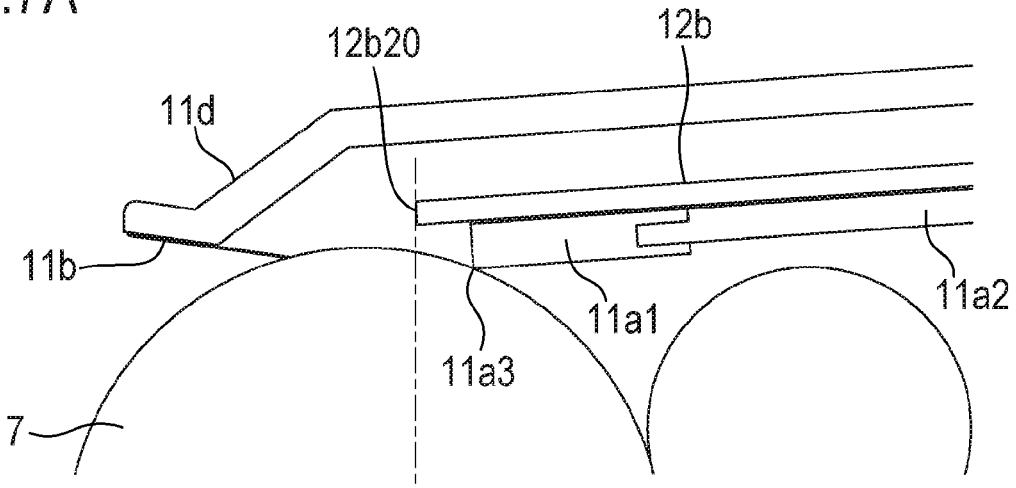
FIGS. 7A to 7C are a set of explanatory diagrams of the waste toner transport mechanism according to Embodiment 1.
Figure 7B:
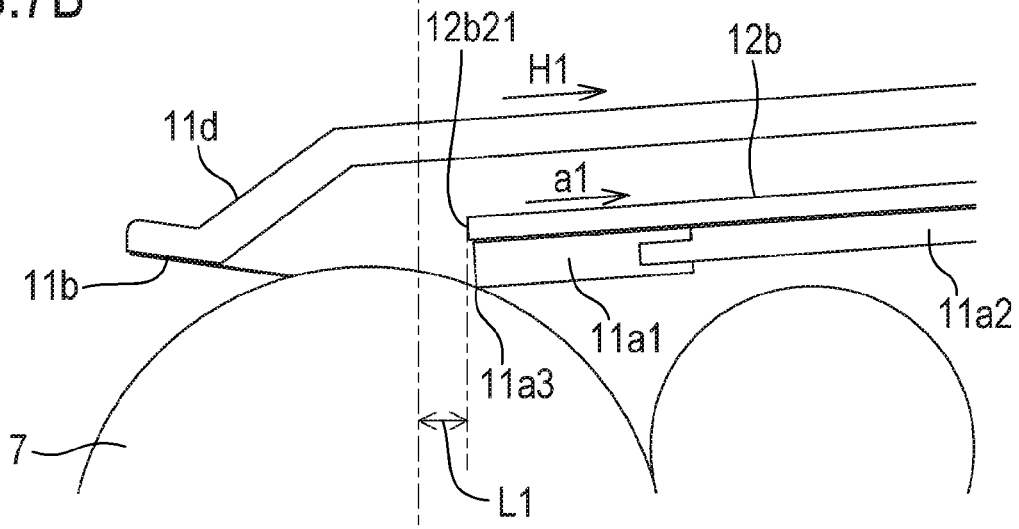

Through rotation of the rotating member 15 in the direction of arrow X illustrated in FIGS. 8A and 8B, prompted by a driving source (not shown) provided in a main body A, the waste toner transport member 12b moves in the movement direction H1 as the waste toner transport direction, as illustrated from FIGS. 7A and 7B. Imparting of the driving force involves herein imparting of acceleration to the waste toner transport member 12b in a direction along the movement the direction H1.

As a result of this operation, the waste toner transport member 12*b* is caused to move from a first position 12*b*20, as a neutral position illustrated in FIGS. 7A and 8A, to a second position 12*b*21 illustrated in FIGS. 7B and 8B. In this case, at least part of the waste toner between the waste toner transport member 12*b* and the cleaning blade 11*a* moves in synchrony with the waste toner transport member 12*b*, without sliding on the lower face of the waste toner transport member 12*b*.

Thereafter, the actuated portion 12*a*3 of the swinging rotating member 12*a* disengages from the gear part 15*a* of the rotating member 15, as illustrated in FIG. 8C, accompanying the rotation of the rotating member 15. As a result, the waste toner transport member 12*b* moves in the H2 direction (see FIG. 8C). That is, acceleration in the movement direction H2 is imparted to the waste toner transport member 12*b* by the urging force of the spring member 16.

Figure 7C:
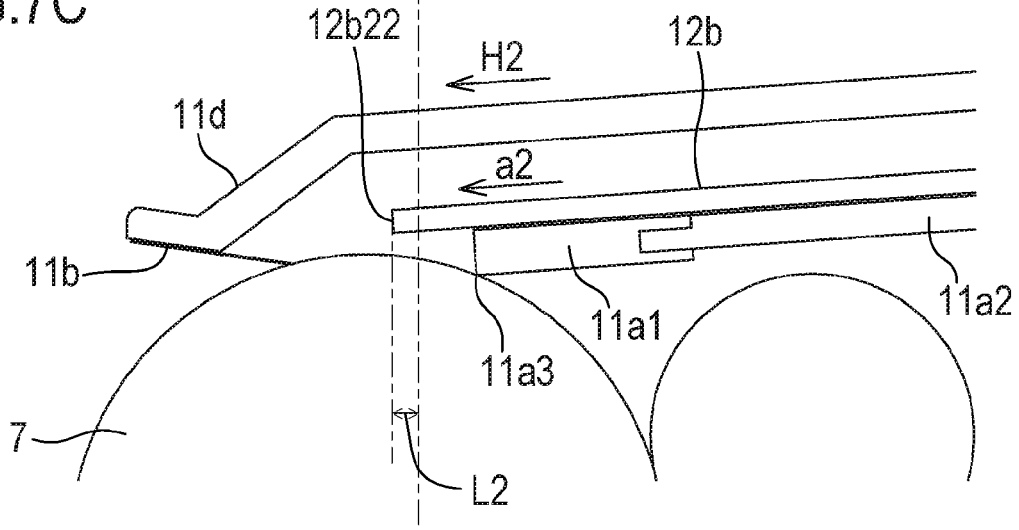

As a result of this operation, the waste toner transport member 12*b* moves from the second position illustrated in FIGS. 7B and 8B to the position illustrated in FIGS. 7C and 8C, via the first position illustrated in FIGS. 7A and 8A. In this case the waste toner between the waste toner transport member 12*b* and the cleaning blade 11*a* slides on the lower face of the waste toner transport member 12*b*.

The spring member 16 functions also as a deceleration member. Specifically, the engagement portion 12*a*2 of the swinging rotating member 12*a* alternately receives from the spring member 16 an urging force, as a restoring force, in the movement direction H1 and the movement direction H2.

Within the accommodating container 14, the waste toner transport member 12*b* is acted upon by a frictional force with the cleaning blade 11*a* illustrated in FIG. 3A and by drag from the waste toner. The oscillation of the waste toner transport member 12*b* is dampened in synchrony with the damping movement of the spring member 16, with a quick return to the first position 12*b*20 illustrated in FIGS. 7A and 8A.

The waste toner transport member 12*b* and the movement of the waste toner between the waste toner transport member 12*b* and the cleaning blade 11*a* (waste toner transport action) will be explained in detail next.

An acceleration setting condition for the basic operation of a developer transport mechanism will be explained with reference to FIGS. 7A to 8C.

Positions and accelerations will be duly defined first.

The position of the leading end of the waste toner transport member 12*b* moving on account of the rotating member 15 and the spring member 16 is defined as follows. Specifically, the first position 12*b*20 denotes the position at which the actuated portion 12*a*3 of the swinging rotating member 12*a* illustrated in FIGS. 7A and 8A does not abut on the rotating member 15. A second position 12*b*21 denotes the position of utmost movement in the movement direction H1, in FIGS. 7B and 8B. A third position 12*b*22 denotes the position of utmost movement in the movement direction H2, in FIGS. 7C and 8C.

The first position 12*b*20 of the leading end of the waste toner transport member 12*b* at that time is disposed so as to extend towards the scooping sheet 11*b* beyond the cleaning portion 11*a*3 of the cleaning blade 11*a*.

The absolute value of a maximum value of acceleration at the time of movement of the waste toner transport member 12*b* in the movement direction H1, prompted by the rotating member 15 and the spring member 16, is defined herein as a maximum acceleration a1, and the absolute value of a maximum value of acceleration at the time of movement of the waste toner transport member 12*b* in the movement direction H2 is defined as a maximum acceleration a2.

The concrete acceleration setting conditions for the basic operation of the developer transport mechanism will be explained next.

To set the maximum acceleration a2 of the waste toner transport member 12*b*, the urging force of the spring member 16 is adjusted to thereby set the acceleration with which the waste toner between the waste toner transport member 12*b* and the cleaning blade 11*a* slides over the lower face of the waste toner transport member 12*b*.

To set the maximum acceleration a1 of the waste toner transport member 12*b*, the rotational speed of the rotating member 15 (revolutions per unit time) is adjusted, to thereby set the maximum acceleration a1 to be smaller than the above-described maximum acceleration a2.

As described above, the urging force F that the cleaning blade 11*a* receives from the waste toner transport member 12*b* is set to take on a larger value than the weight of waste toner that can be loaded between the waste toner transport member 12*b* and the cleaning blade 11*a*. In that case the condition under which the waste toner between the waste toner transport member 12*b* and the cleaning blade 11*a* slides over the lower face of the waste toner transport member 12*b* is as described below.

Herein, it is assumed that the static friction coefficient of waste toner with the waste toner transport member 12*b* is set to μ0, a gravitational acceleration is set to G, and the product of the gravitational acceleration G and the static friction coefficient μ0 is set to μ0G. In this case, the waste toner slides over the lower face of the waste toner transport member 12*b* when the acceleration with which the waste toner transport member 12*b* is caused to move is set to be larger than μ0G.

An explanation follows next on the maximum acceleration a1, the maximum acceleration a2, and on μ0G which is the product of the static friction coefficient μ0 and gravitational acceleration G, and on the transportability of the waste toner.

Case 1

Acceleration Setting Condition Allowing for Waste Toner Transport

The above condition is as follows when the acceleration setting is $\mu 0G<a1<a2$.

In a case where the waste toner transport member 12*b* is caused to move at the maximum accelerations a1 and a2 in the movement directions H1, H2, the toner sliding over the lower face of the waste toner transport member 12*b* moves relatively in the movement direction H1, over the lower face of the waste toner transport member 12*b*, when the waste toner transport member 12*b* is caused to move in the movement direction H2. That is, the waste toner on the lower face of the waste toner transport member 12*b* moves both in the H1 direction and the H2 direction, on the lower face of the waste toner transport member 12*b*. In this case, it is set as $a1<a2$, and accordingly the relative movement distance of the waste toner as viewed from the waste toner transport member 12*b* is readily set to be longer when the waste toner transport member 12*b* is caused to move in the movement direction H2 than when the waste toner transport member 12*b* is caused to move in the movement direction H1. The relative movement distance of the waste toner as viewed from the waste toner transport member 12*b* denotes the distance over which the waste toner slides on the lower face of the waste toner transport member. In a case where the above-described acceleration is set, therefore, the waste toner between the waste toner transport member 12*b* and the cleaning blade 11*a* can be easily caused to move in the movement direction H1, through repeated application of the above acceleration to the waste toner transport member 12*b*.

Case 2

Acceleration Setting Condition with Increased Toner Transport Amount as Compared with Case 1

The above condition is as follows when the acceleration setting is $a1<\mu 0G<a2$.

When the waste toner transport member 12*b* is caused to move in the movement direction H1, waste toner between the waste toner transport member 12*b* and the cleaning blade 11*a* moves in the movement direction H1, on account of a maximum acceleration a1 that is smaller than μ0G.

When the waste toner transport member 12*b* is caused to move in the movement direction H2, the waste toner between the waste toner transport member 12*b* and the cleaning blade 11*a* slides over the lower face of the waste toner transport member 12*b*, on account of the maximum acceleration a2 that is larger than μ0G, and as a result does not move in the movement direction H2. In a case where the above-described acceleration is set, therefore, the waste toner between the waste toner transport member 12*b* and the cleaning blade 11*a* can be easily caused to move in the movement direction H1 through repeated application of the above acceleration to the waste toner transport member 12*b*.

If the acceleration is thus set properly, the amount of toner transported in the orientation of the movement direction H1, in one reciprocation, can be readily increased even if the trajectory over which the waste toner transport member 12*b* moves in one reciprocation is prescribed to be completely identical to that of Case 1.

Case 3

Acceleration Setting Condition Not Allowing for Waste Toner Transport

In a case where by contrast the maximum acceleration a2 is set to obey $a2<\mu 0G$, the waste toner cannot slide over the lower face of the waste toner transport member 12*b*. As a result, when the waste toner transport member 12*b* is caused to move in the movement direction H2, the waste toner moves in the movement direction H2 along with the waste toner transport member 12*b*.

In the present example, specifically, the waste toner is transported in the orientation of the movement direction H1, and therefore it is necessary to set the maximum acceleration a2 ($\mu 0G<a2$) so that the waste toner slides over the lower face of the waste toner transport member 12*b* when the waste toner transport member 12*b* moves in the orientation of the movement direction H2.

In the process described above, an instance has been explained in which the waste toner between the waste toner transport member 12*b* and the cleaning blade 11*a* is transported in the movement direction H1, on the lower face of the waste toner transport member 12*b*, but the process is not limited thereto. In the case of waste toner lying on the top face of the waste toner transport member 12*b*, the own weight of the waste toner produces the same action as the urging force F. Therefore, the waste toner between the waste toner transport member 12*b* and the cleaning frame 11*d* can be transported in the movement direction H1, on the top face of the waste toner transport member 12*b*, by virtue of an identical acceleration setting condition.

The above-described static friction coefficient μ0 of toner with the waste toner transport member 12*b* is calculated on the basis of $\mu 0=\tan\theta$, where θ denotes the angle formed between the waste toner transport member 12*b* and the horizontal plane when waste toner placed on the waste toner transport member 12*b* slides down upon tilting of the waste toner transport member 12*b*.

At angle θ or a larger angle, the toner on the waste toner transport member 12*b* slide downs from the waste toner transport member 12*b* as a result of slipping occurring at the interface between the waste toner transport member 12*b* and further the toner, and slipping occurring at the interface of toner and toner.

Specifically, sliding of the toner over the oscillating waste toner transport member 12*b* is not limited to sliding of toner on the waste toner transport member 12*b*, occurring at the interface between the waste toner transport member 12*b* and the toner, but encompasses also sliding at the interface between toner and toner lying overhead, and caused by the former sliding.

The above-described urging force F is a pressing force that is measured, using a force gauge, at an abutting position between the waste toner transport member 12*b* and the cleaning blade 11*a*, upon removal of the cleaning blade 11*a* in a state where the waste toner transport member 12*b* is assembled in the cleaning frame 11*d*.

The waste toner between the cleaning frame 11*d* and the cleaning blade 11*b* is transported in the movement direction H1, which is the waste toner transport direction, and is accommodated in the waste toner accommodating portion 11*c*, as a result of a repeated reciprocating motion of the waste toner transport member 12*b* in the movement directions H1, H2 in the above-described process.

In the present cases accelerations were set to obey $a1<\mu 0G<a2$.

Explanation of the Effect

The waste toner transport effect of the waste toner transport member 12*b* will be explained next with reference to FIGS. 10A to 11B.

Figure 10A:
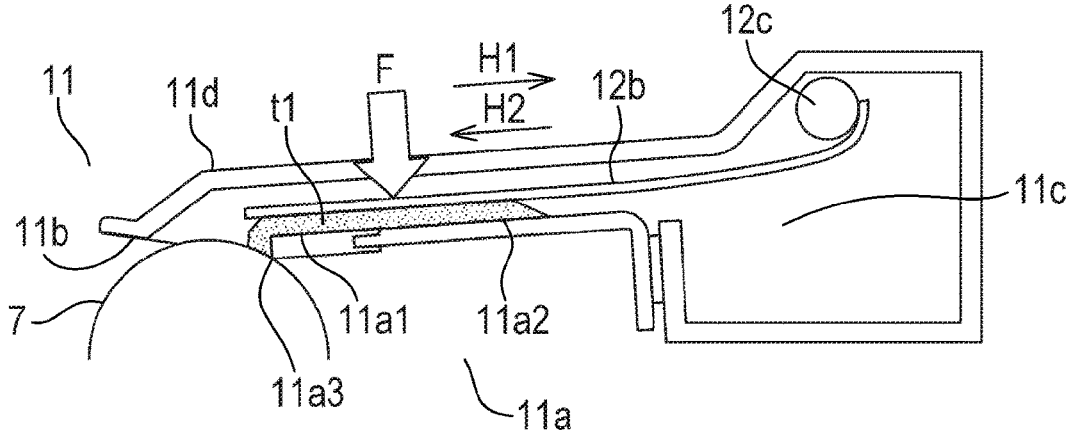
FIGS. 10A to 10C are a set of explanatory diagrams of the waste toner transport mechanism according to Embodiment 1.
Figure 10B:
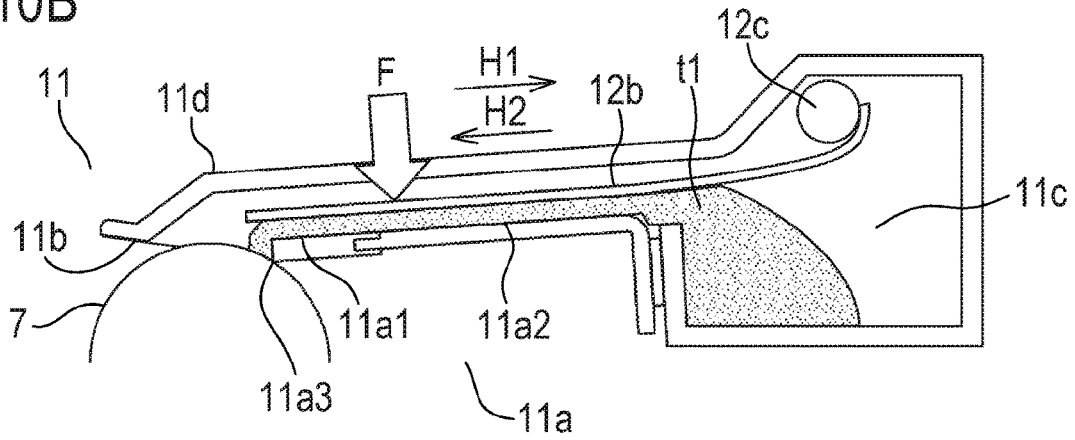
Figure 10C:
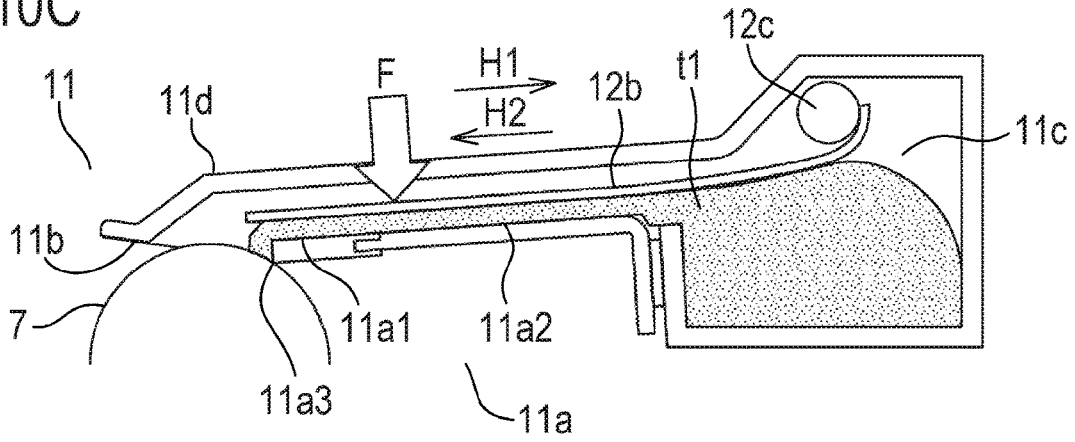

The waste toner remaining on the photosensitive member drum 7 is scraped by the cleaning portion 11*a*3 of the cleaning blade 11*a*, and intrudes between the waste toner transport member 12*b* and the cleaning blade 11*a*, against the urging force F of the waste toner transport member 12*b*. As a result of the above-described waste toner transport action of the waste toner transport member 12*b*, waste toner t1 is transported in the movement direction H1, from the rubber part 11*a*1 of the cleaning blade 11*a* towards the waste toner accommodating portion 11*c* along the sheet metal part 11*a*2, as illustrated in FIG. 10A. Further, the state of the waste toner t1 within the waste toner accommodating portion 11*c* changes from the state illustrated in FIG. 10B to that illustrated in FIG. 10C, accompanying an increase in the waste toner amount fed to the waste toner accommodating portion 11*c* by the waste toner transport member 12*b*. As a result, it becomes possible to achieve waste toner transport in which the volume of the waste toner accommodating portion 11*c* is sufficiently utilized.

Figure 11A:
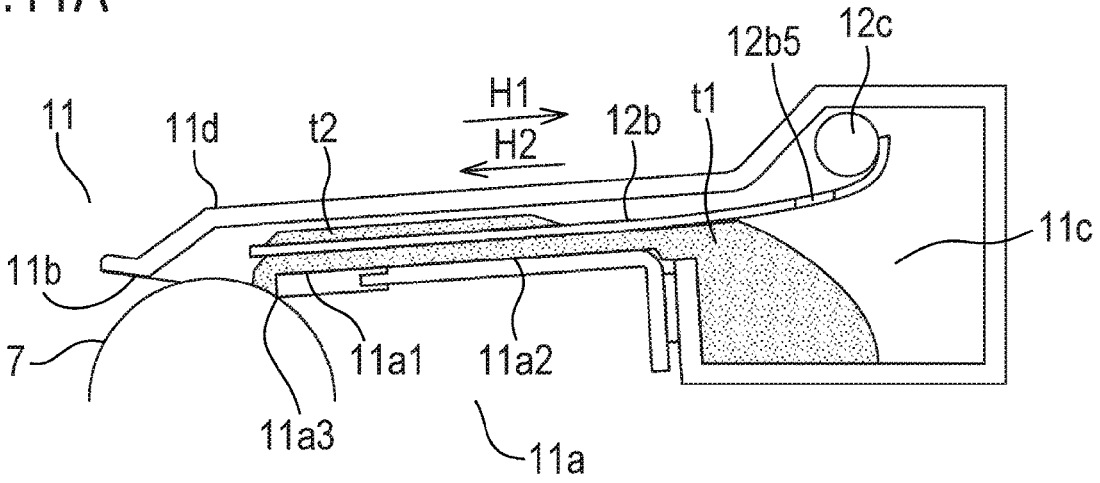
FIGS. 11A and 11B are a set of explanatory diagrams of the waste toner transport mechanism according to Embodiment 1.
Figure 11B:
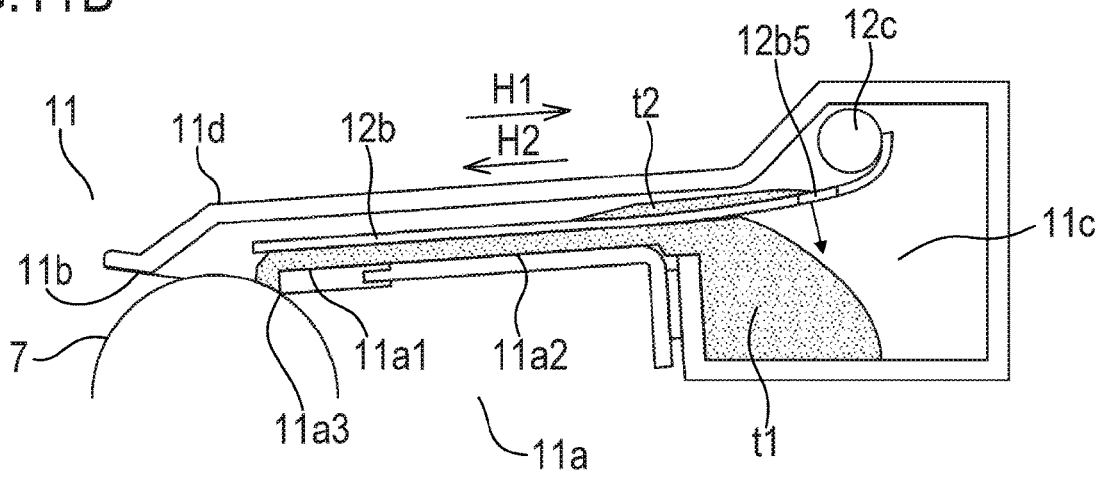

Even in a case where waste toner t2 remains on the top face of the waste toner transport member 12*b*, as illustrated in FIG. 11A, for instance as a result of removal of the cartridge B from an image forming apparatus A, that waste toner t2 is transported in the movement direction H1 as a result of the above-described waste toner transport action of the waste toner transport member 12*b*. As illustrated in FIG. 11B, the waste toner t2 moving over the top face of the waste toner transport member 12*b* in the movement direction H1 is discharged to the waste toner accommodating portion 11*c*, through the communication holes 12*b*5 of the waste toner transport member 12*b*, in the vicinity of the transport shaft 12*c*.

In the waste toner transport of the waste toner transport member of the present example, a large portion of the waste toner transported on the lower face or the top face of the waste toner transport member moves in the movement direction H1, which is the waste toner transport direction, with virtually no waste toner moving in the movement direction H2.

The waste toner transport mechanism of the present example allows thus transporting waste toner transport, by the waste toner transport mechanism, with savings in space and with reduced return of the waste toner to the cleaning portion 11*b*3 of the cleaning blade 11*b*. As a result, the occurrence of faulty cleaning can be suppressed, and a stable image can be provided to the user.

In FIGS. 10A to 11B, when a waste toner powder pressure exerted on the waste toner accommodating portion 11*c* exceeds a given value during transport of the waste toners t1 and t2, waste toner slides over the lower face and the top face of the waste toner transport member 12*b* also at the time of movement of the waste toner transport member 12*b* in the movement direction H1. As a result, the waste toner powder pressure exerted on the waste toner accommodating portion 11*c* by the waste toner transport member 12*b* does not increase excessively, to or above the frictional force between the waste toner transport member 12*b* and waste toner, or the frictional force between waste toner particles. Therefore, load torque equal to or greater than a given value is not exerted on the waste toner transport mechanism.

The operation conditions of the rotating member 15 in the present example were set as follows. Specifically, the rotational speed of the rotating member 15 was set to 300 rpm, the frequency of the force applied to the actuated portion 12*a*3 of the swinging rotating member 12*a* by the rotating member 15 was set to 10 Hz, and the angle at which the swinging rotating member 12*a* swung as a result of the action of the rotating member 15 thereon was set to 30°.

Further, a movement distance L1 of the leading end 12*b*2 which is the difference between the position 12*b*21 of the leading end 12*b*2 and the initial position 12*b*20 of the waste toner transport member 12*b*, illustrated in FIGS. 7A to 7C, was selected to be about 1.5 mm.

Further, a movement distance L2 of a leading end 12*b*2 which is the difference between the position 12*b*22 and the initial position 12*b*20 of the leading end 12*b*2 of the waste toner transport member 12*b* was set to take on a value smaller than the movement distance L1. These distance settings are established taking into consideration the fact that the movement distance L2 varies depending on the weight of waste toner within the waste toner accommodating portion 11*c*, and depending on the resistance from the spring member 16 at a time where the waste toner transport member 12*b* moves in the transport direction H2.

The inclination angle of the cleaning blade 11*a* with respect to the horizontal plane, illustrated in FIG. 3A, was selected to be about 4°, and the urging force F received by the cleaning blade 11*a* from the waste toner transport member 12*b* was selected to be 10 gf.

The urging force in the transport direction H2 received by the engagement portion 12*a*2 of the swinging rotating member 12*a* from the spring member 16, at the time of a 30° rotation of the swinging rotating member 12*a* prompted by the rotating member 15, was selected to be 100 gf.

The above various conditions are suitable set values for the device configuration in the present example, but are not limited to these values, and can be selected as appropriate for instance depending on the type and characteristics of the toner, and on the shape, material and arrangement of the various members.

The configuring material of the waste toner transport member 12*b* is not limited to polyethylene terephthalate (PET), and can be appropriately a general plastic material such as polystyrene (PS), polyimide (PI), a polyphenylene sulfide resin (PPS), polyethylene (PE), polypropylene (PP), an ABS resin, polycarbonate (PC) and polyacetal (POM).

Embodiment 2

In Embodiment 1, a configuration has been illustrated in which the transport shaft 12*c* of the waste toner transport member 12*b* is disposed on the side of the waste toner accommodating portion 11*c*, but the transport shaft 12*c* is not limited to being configured in this manner.

Figure 12:
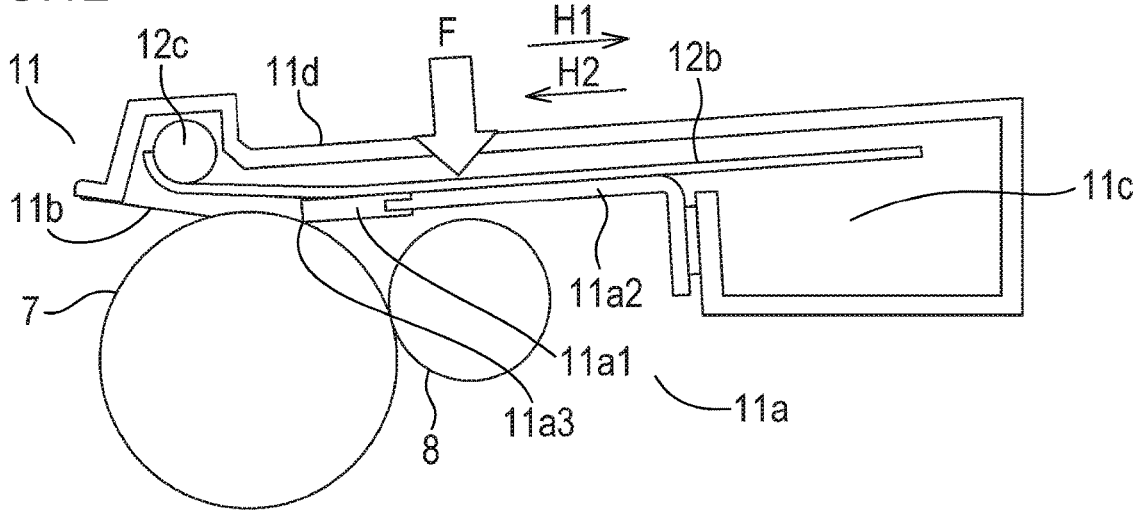
FIG. 12 is a schematic cross-sectional diagram of a cleaning unit according to Embodiment 2.

In Embodiment 2 of the present invention the transport shaft 12*c* of the waste toner transport member 12*b* is disposed on the side of the scooping sheet 11*b*, as illustrated in FIG. 12.

Features not particularly described in Embodiment 2 are identical to those in Embodiment 1, and will not be explained again herein.

In the configuration of Embodiment 2 a drive train of the waste toner transport mechanism is disposed in the vicinity of the photosensitive member drum, as compared with the instance described above in Embodiment 1, where the transport shaft 12*c* of the waste toner transport member 12*b* is disposed on the side of the waste toner accommodating portion 11*c*.

In a configuration where a gear train that transmits a driving force to the photosensitive member drum 7 and a gear train that transmits a driving force to the waste toner transport member 12*b* are coupled to each other, it becomes as a result possible to arrange those gear trains while saving space.

Embodiment 3

In Embodiment 1 a configuration has been illustrated in which the waste toner transport member 12*b* is made up of a sheet member, and the elasticity of the sheet member is utilized as an urging member of the waste toner transport member 12*b* on the cleaning blade 11*a*; however, the manner in which the urging force is imparted is not limited thereto.

Figure 13:
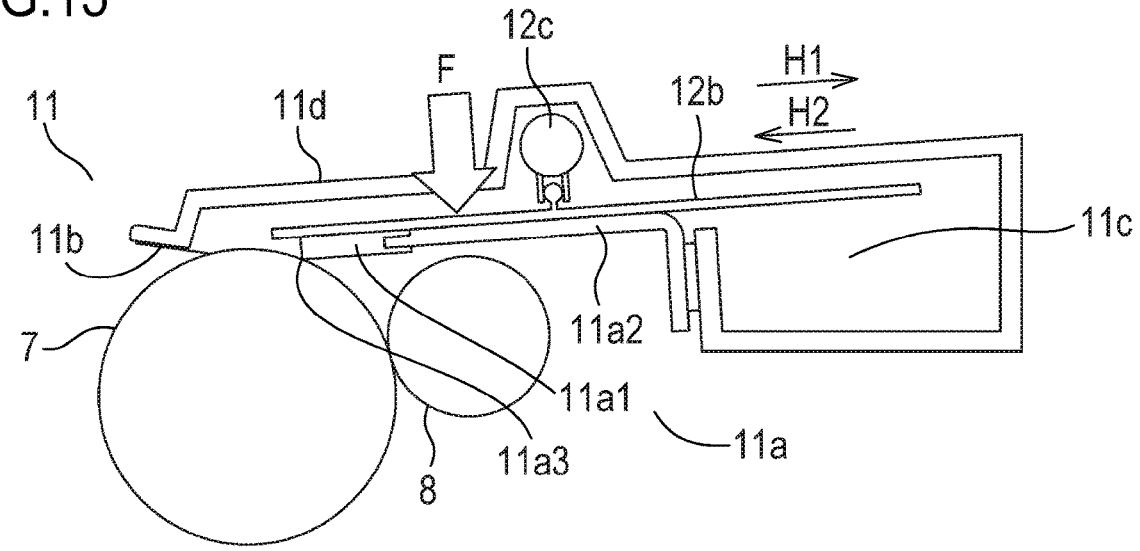
FIG. 13 is a schematic cross-sectional diagram of a cleaning unit according to Embodiment 3.

In Embodiment 3 of the present invention a configuration is resorted to such as that illustrated in FIG. 13. Firstly, the waste toner transport member 12*b* was configured as a plate-shaped member. The waste toner transport member 12*b* and the transport shaft 12*c* are connected using a known link mechanism, and the urging force F of the waste toner transport member 12*b* onto the cleaning blade 11*a* was exerted by the weight of the waste toner transport member 12*b*.

Features not particularly described in Embodiment 3 are identical to those in working examples above, and will not be explained again herein.

In Embodiment 1 described above a configuration was adopted in which the waste toner transport member 12*b* was made up of a sheet member, and the elasticity of the sheet member was utilized as an urging member of the waste toner transport member 12*b* onto the urging member to the cleaning blade 11*a*. The configuration of Embodiment 3 allows preventing changes in the urging force F through deformation of the waste toner transport member 12*b*, as compared with the configuration in Embodiment 1.

As a result, transport of waste toner by the waste toner transport member 12*b* can be accomplished more stably.

Embodiment 4

In Embodiment 3, an instance has been illustrated in which the weight of the waste toner transport member is utilized as a feature for imparting the urging force F of the waste toner transport member 12*b* onto the cleaning blade 11*a*, but the manner in which the urging force is imparted is not limited thereto.

Figure 14:
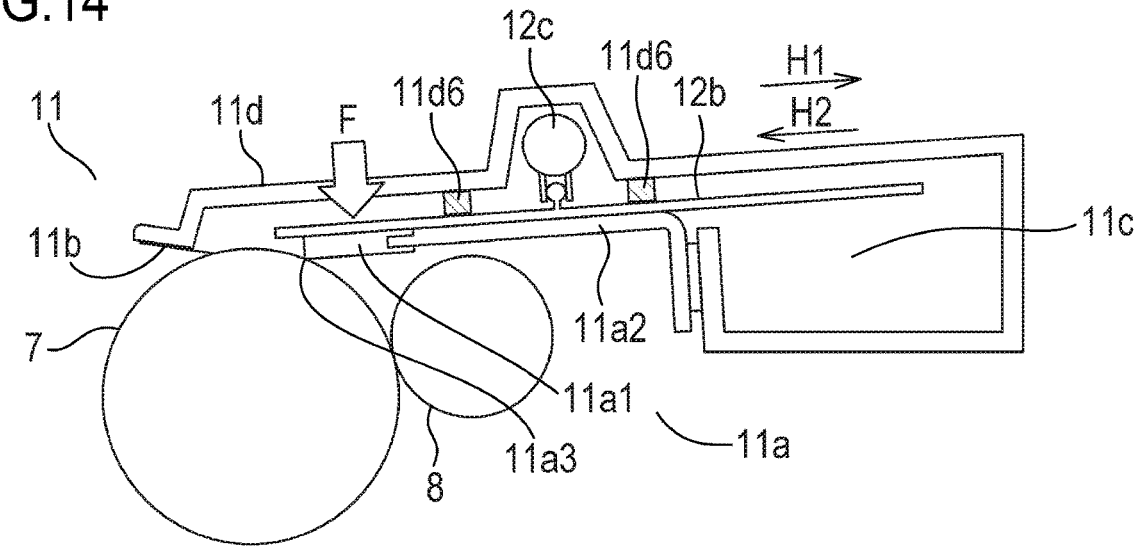
FIG. 14 is a schematic cross-sectional diagram of a cleaning unit according to Embodiment 4.

As illustrated in FIG. 14, a configuration may be adopted in which the urging force F is exerted through pressing of the waste toner transport member 12*b* against the cleaning blade 11*a* by urging members 11*d*6 as an urging portion. The urging members 11*d*6 are disposed so as to abut on the surface, of the waste toner transport member 12*b*, on the side opposite with the side that abuts on the cleaning blade 11*a*, and so as to exert an urging force.

Features not particularly described in Embodiment 4 are identical to those in working examples above, and will not be explained again herein.

In Embodiment 3 described above a configuration was adopted in which the urging force F of the waste toner transport member 12*b* onto the cleaning blade 11*a* was imparted by the weight of the waste toner transport member 12*b*. In the configuration of Embodiment 4 the waste toner between the waste toner transport member 12*b* and the cleaning blade 11*a* can be transported more efficiently than in the configuration of Embodiment 3.

Embodiment 5

In Embodiment 4, an instance has been illustrated in which the urging members 11*d*6 are utilized as a configuration for imparting the urging force F of the waste toner transport member 12*b* onto the cleaning blade 11*a*, but the manner in which the urging force is imparted is not limited thereto.

Figure 15:
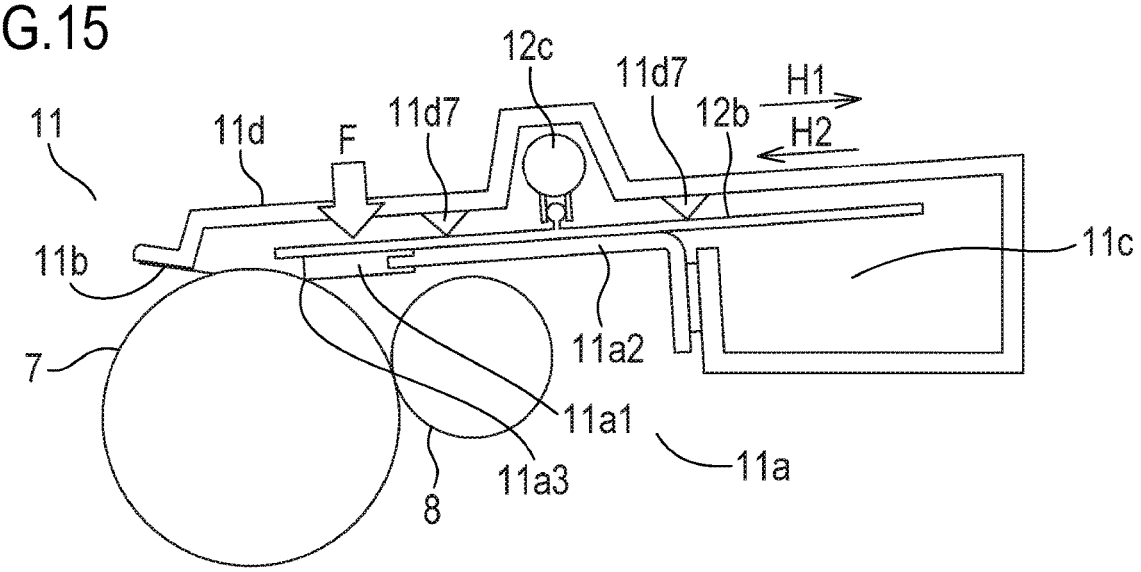
FIG. 15 is a schematic cross-sectional diagram of a cleaning unit according to Embodiment 5.

As illustrated in FIG. 15, a configuration may be adopted in which the urging force F is exerted through pressing of the waste toner transport member 12*b* against the cleaning blade 11*a* by ribs 11*d*7, as an urging portion provided on the cleaning frame 11*d*.

Features not particularly described in Embodiment 5 are identical to those in working examples above, and will not be explained again herein.

In Embodiment 4 described above, a configuration was adopted in which the urging force F of the waste toner transport member 12*b* onto the cleaning blade 11*a* was imparted by the urging members 11*d*6. In the configuration of Embodiment 5, the waste toner between the waste toner transport member 12*b* and the cleaning blade 11*a* can be transported efficiently, and relying on a simpler configuration, than in the configuration of Embodiment 4.

In Embodiments 1 to 5 instances have been illustrated in which the cleaning blade is tilted by 4° with respect to the horizontal plane when the cleaning unit is fitted to the image forming apparatus, but the incidence angle is not limited thereto.

Specifically, the oscillation configuration of the waste toner transport member 12*b* illustrated in Embodiment 1 allowed transporting waste toner between the waste toner transport member 12*b* and the cleaning blade 1 lain the movement direction H1, with the inclination angle of the waste toner transport member 12*b* set to a climbing angle of 10°. The inclination angle of the waste toner transport member 12*b* in the downward direction is not limited to that angle, and toner can be transported also at angles equal to or smaller than the angle of rest of the toner. That is, the inclination angle of the transport direction of the waste toner transport member 12*b*, in the waste toner transport configuration of the examples, can be set to be equal to or smaller than 10 degrees in the upward direction and within a range of 90 degrees in the downward direction.

In Embodiments 1 to 5 instances have been illustrated in which the restoring force of an urging member is used as a deceleration member of the waste toner transport member, but the deceleration member is not limited thereto. For instance, a known shock absorbing member or a known friction sliding member may be disposed, in the cleaning frame, as a deceleration member of the transport member.

The cartridge in Embodiments 1 to 5 was configured so as to form monochromatic images. However, the cartridge may be provided with a plurality of developing unit (developing apparatuses), for forming images of a plurality of colors (for instance two-color images, three-color images or full-color images).

The frequency of the reciprocating motion of the transport member is 1 to 100 Hz.

In the description of Embodiments 1 to 5 no mention is made of a feature wherein the transport member includes an elastic body. However, the invention can be suitably used also in a case where the transport member is made up of an elastic body that retains a substantially sheet shape or plate shape, allowing for transport of toner.

As described above, the configurations in any of Embodiments 1 to 5 allow operating a waste toner transport member so as to reduce waste toner return to the cleaning portion of the cleaning blade, and to enable transport of waste toner such that the occurrence of faulty cleaning is curtailed to greater degree than in conventional art.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-067481, filed on Mar. 29, 2019, which is hereby incorporated by reference herein in its entirety.

What is claimed is:

1. A cleaning unit comprising:

a container frame which is provided with an opening for attaching an image bearing member;

a cleaning member which is provided on the container frame and which removes a developer from the surface of the image bearing member, the developer removed by the cleaning member being contained inside the container frame;

a transport member which is provided inside the container frame and which transports, from an opening side of the container frame corresponding to the opening of the container frame to a deep side of the container frame, the developer removed by the cleaning member, the deep side being opposite to the opening side; and a rotating unit which drives the transport member such that (a) the transport member moves relatively with respect to the cleaning member, and (b) an absolute value of maximum acceleration at the time of movement of the transport member in a direction from the opening side towards the deep side is smaller than an absolute value of maximum acceleration at the time of movement in a direction from the deep side towards the opening side.

2. The cleaning unit according to claim 1, wherein the transport member includes:

(a) a rotatable rotating shaft; and (b) a flexible sheet-shaped member having one end attached to the rotating shaft and the other end being a free end, the flexible sheet-shaped member being disposed such that in an attitude during use, a lower surface of the flexible sheet-shaped member is in contact with a top face of the cleaning member, and wherein the rotating unit causes the rotating shaft to rotate, to thereby cause the flexible sheet-shaped member to move relatively with respect to the cleaning member.

3. The cleaning unit according to claim 2, wherein the flexible sheet-shaped member is able to deform elastically, and wherein the flexible sheet-shaped member is disposed so as to be in contact, in a deflected state, with the top face of the cleaning member, in an attitude during use.

4. The cleaning unit according to claim 2, wherein the transport member comprises an urging member for urging the flexible sheet-shaped member towards the cleaning member.

5. The cleaning unit according to claim 2, wherein the rotating shaft is disposed on the deep side inside the container frame.

6. The cleaning unit according to claim 2, wherein the rotating shaft is disposed upward of the cleaning member in a gravity direction, in an attitude during use.

7. The cleaning unit according to claim 1, wherein the container frame includes a rib that abuts on a surface on one side of the transport member, while the transport member abuts on the cleaning member on the other side opposite to the one side of the transport member.

8. The cleaning unit according to claim 1, wherein the transport member has a communicating hole that communicates one side of the transport member that abuts on the cleaning member with the other side of the transport member that is opposite to the one side of the transport member.

9. The cleaning unit according to claim 1, wherein the cleaning member is disposed so as to extend from one end fixed to the container frame towards the other end abutting on the surface of the image bearing member, in a direction opposite to the rotation direction of the image bearing member, at a region at which the other end of the cleaning member abuts on the surface of the image bearing member.

10. A cartridge attachable to and detachable from a main body of an image forming apparatus, the cartridge comprising:

an image bearing member; and a cleaning unit, wherein the cleaning unit comprises:

(1) a container frame which is provided with an opening for attaching the image bearing member;

(2) a cleaning member which is provided on the container frame and which removes a developer from the surface of the image bearing member, the developer removed by the cleaning member being contained inside the container frame;

(3) a transport member which is provided inside the container frame and which transports, from an opening side of the container frame corresponding to the opening of the container frame to a deep side of the container frame, the developer removed by the cleaning member, the deep side being opposite to the opening side; and (4) a rotating unit which drives the transport member such that (a) the transport member moves relatively with respect to the cleaning member, and (b) an absolute value of maximum acceleration at the time of movement of the transport member in a direction from the opening side towards the deep side is smaller than an absolute value of maximum acceleration at the time of movement in a direction from the deep side towards the opening side.

11. An image forming apparatus comprising:

a main body; and a cartridge attachable to and detachable from the main body, wherein the cartridge comprises:

(A) an image bearing member; and (B) a cleaning unit, wherein the cleaning unit comprises:

(1) a container frame which is provided with an opening for attaching the image bearing member;

(2) a cleaning member which is provided on the container frame and which removes a developer from the surface of the image bearing member, the developer removed by the cleaning member being contained inside the container frame;

(3) a transport member which is provided inside the container frame and which transports, from an opening side of the container frame corresponding to the opening of the container frame to a deep side of the container frame, the developer removed by the cleaning member, the deep side being opposite to the opening side; and (4) a rotating unit which drives the transport member such that (a) the transport member moves relatively with respect to the cleaning member, and (b) an absolute value of maximum acceleration at the time of movement of the transport member in a direction from the opening side towards the deep side is smaller than an absolute value of maximum acceleration at the time of movement in a direction from the deep side towards the opening side.

* * * * *